US005813563A

United States Patent [19]

Boehm et al.

[11] Patent Number: 5,813,563

[45] Date of Patent: Sep. 29, 1998

[54] CLOSURE HAVING EASY-OPEN PROMOTION COMPARTMENT

[75] Inventors: Ted W. Boehm, Crawfordsville; David E. Babcock, Lafayette; Hugh C. Urmston, Carmel; Daniel J. Denman, Crawfordsville, all of Ind.; Joseph M. Ladina, Marietta, Ga.

[73] Assignee: Alcoa Closure Systems International, Inc., Crawfordsville, Ind.

[21] Appl. No.: 749,415

[22] Filed: Nov. 15, 1996

[51] Int. Cl.[6] ..... B65D 1/24

[52] U.S. Cl. ..... 220/522; 215/6; 215/228; 206/217

[58] Field of Search ..... 215/228, 6, 250, 215/253, 254, 257, 258, DIG. 8, DIG. 3; 220/522, 212, 281, 521, 256, 258, 523, 526; 206/217, 459.1, 214, 216, 219, 499, 223, 222; 229/201, 202, 123

[56] References Cited

U.S. PATENT DOCUMENTS

| | | | |
|---|---|---|---|
| 2,891,713 | 6/1959 | O'Neil | 229/201 |
| 3,613,955 | 10/1971 | Wetherell, Jr. | 206/222 X |
| 4,475,654 | 10/1984 | Fruchter | 220/521 X |
| 4,513,861 | 4/1985 | Baram | 215/DIG. 8 X |
| 4,667,818 | 5/1987 | Evans | 215/DIG. 8 X |
| 4,795,028 | 1/1989 | Wittig et al. | 206/217 |
| 4,903,865 | 2/1990 | Janowitz | 206/222 X |
| 4,919,949 | 4/1990 | Miltz et al. | 229/201 X |
| 5,056,659 | 10/1991 | Howes et al. . | |
| 5,114,011 | 5/1992 | Robbins, III | 206/219 X |
| 5,524,788 | 6/1996 | Plester | 215/228 X |

FOREIGN PATENT DOCUMENTS

| | | | |
|---|---|---|---|
| 2623477 | 5/1989 | France | 215/DIG. 3 X |
| 2356138 | 5/1975 | Germany | 229/201 |

*Primary Examiner*—Allan N. Shoap
*Assistant Examiner*—Nathan Newhouse
*Attorney, Agent, or Firm*—Rockey, Milnamow & Katz, Ltd.

[57] ABSTRACT

A promotional closure includes an outer closure cap, and a removable inner promotion compartment for receiving an associated promotional element such as a coupon, game piece, currency, or the like. The promotion compartment has a generally cup-shaped configuration, including a circular bottom wall, and an upstanding generally cylindrical side wall. An annular flange extends generally outwardly from the side wall, and includes a detachable portion whereby the annular flange can act as a pull-ring or finger grip to facilitate opening or splitting of the side wall of the compartment. The annular flange is preferably connected to a hingedly detachable section of the side wall which can be pulled open by manipulation of the flange to facilitate access to the contents of the compartment.

12 Claims, 2 Drawing Sheets

CLOSURE HAVING EASY-OPEN PROMOTION COMPARTMENT

TECHNICAL FIELD

The present invention relates generally to promotional closures for containers configured for use in connection with a sales promotion or game, and more particularly to a promotion-receiving compartment for a closure which is configured to facilitate easy-opening by consumers for removal of a promotional element from within the compartment.

BACKGROUND OF THE INVENTION

Promotions and games which are associated with the sale of products have shown enduring popularity with consumers. A wide variety of such promotions and games are known, and may include gaming systems where game elements are collected to receive an award, or receipt by a consumer of a promotional element which can be redeemed for an award, or which may have intrinsic value for the consumer.

Promotional systems for use with container closures have heretofore taken various forms. For example, it has been known to provide the liner portion of a closure in the form of a gaming piece, whereby collection of certain ones of the liners permits prize redemption, or the liners themselves can be individually redeemed for cash or other awards. It has also been known to provide container closures with a compartment element positionable generally within the closure so that a promotional element can be positioned within the compartment for removal upon opening of the container. Closure/compartment arrangements of this nature are disclosed in U.S. Pat. No. 5,056,659, to Howes et al., hereby incorporated by reference.

The present invention is directed to an easy-open promotion-receiving member for a promotional closure which is configured to facilitate convenient manipulation and opening by consumers for use in a promotional or gaming system.

SUMMARY OF THE INVENTION

A promotional closure with which the present invention is particularly suited for use includes an outer plastic closure cap having a circular top wall portion and a depending annular skirt portion. The closure is adapted for application to an associated container, typically by the provision of interengaging threads. In accordance with the present invention, the promotion-receiving member of the closure includes a cup-shaped promotion compartment positionable generally beneath the top wall portion of the outer closure cap. Notably, the promotion compartment includes a detachable flange portion which functions in the nature of a finger grip, and a frangible side wall section. The detachable flange portion detaches from the cup-shaped promotion compartment, and preferably remains joined to the frangible side wall section. By this arrangement, a promotional element positioned within the compartment can be easily removed by pulling on the finger grip, and splitting a side wall portion of the compartment, all of which can be accomplished without resort to tools or other implements.

As noted, the promotion compartment of the present invention is positionable beneath the top wall portion of the outer closure cap, and inwardly of the annular skirt portion of the cap for disposition generally within an associated container. The cup-shaped promotion compartment includes a circular bottom wall, and an upstanding, generally cylindrical side wall extending upwardly therefrom. In the preferred form, the compartment includes an annular flange extending outwardly from the side wall, with a detachable portion of the flange being detachable from a preferably major portion of the side wall of the compartment.

In accordance with the illustrated embodiment, the side wall of the compartment comprises a frangible portion which can be opened after the closure is removed from the associated container and the promotion compartment is removed from within the closure cap. Opening of the frangible portion of the compartment facilitates removal of a promotional element, such as a coupon, currency, or other promotional item, from within the promotion compartment.

In the preferred form, the frangible portion of the side wall comprises a side wall section and a pair of circumferentially spaced weakened regions which extend generally axially of the compartment. Fracture of the weakened regions permits hinging movement of the side wall section about an integral hinge which joins the side wall section to the remainder of the compartment.

Manipulation and opening of the side wall section is facilitated by the connection of the annular flange of the compartment to the hinged side wall section. In particular, the annular flange is joined to the side wall section, but detachable from the remainder of the side wall by the provision of a circumferentially extending weakened region. Notably, a plurality of circumferentially spaced frangible gussets extend between the side wall and the annular flange in the area of the weakened region.

By this arrangement, the annular flange acts in the nature of a finger grip or pull-ring to facilitate opening of the compartment. The detachable portion of the annular flange can be detached from the side wall, by finger manipulation, with further manipulation of the flange acting to separate and open the hinged side wall section. The promotion compartment is thus split or opened from its cup-shaped configuration, facilitating convenient access to a promotional element carried within the compartment.

In the preferred form, indicia means are provided on the compartment for indicating a start area of the detachable portion of the annular flange at which finger pressure is to be applied by consumers. Notably, the circumferentially spaced gussets of the compartment are arranged such that a pair of the gussets are spaced apart to define a gusset-free finger grip of the detachable portion of the annular flange. The indicia means of the compartment are positioned adjacent to this gusset-free finger grip for convenient use by consumers. A preferred fabrication of the compartment from low density polyethylene further facilitates convenient opening of the compartment.

Other features and advantages of the present invention will become readily apparent from the following detailed description, the accompanying drawings, and the appended claims.

DETAILED DESCRIPTION

Figure 1:
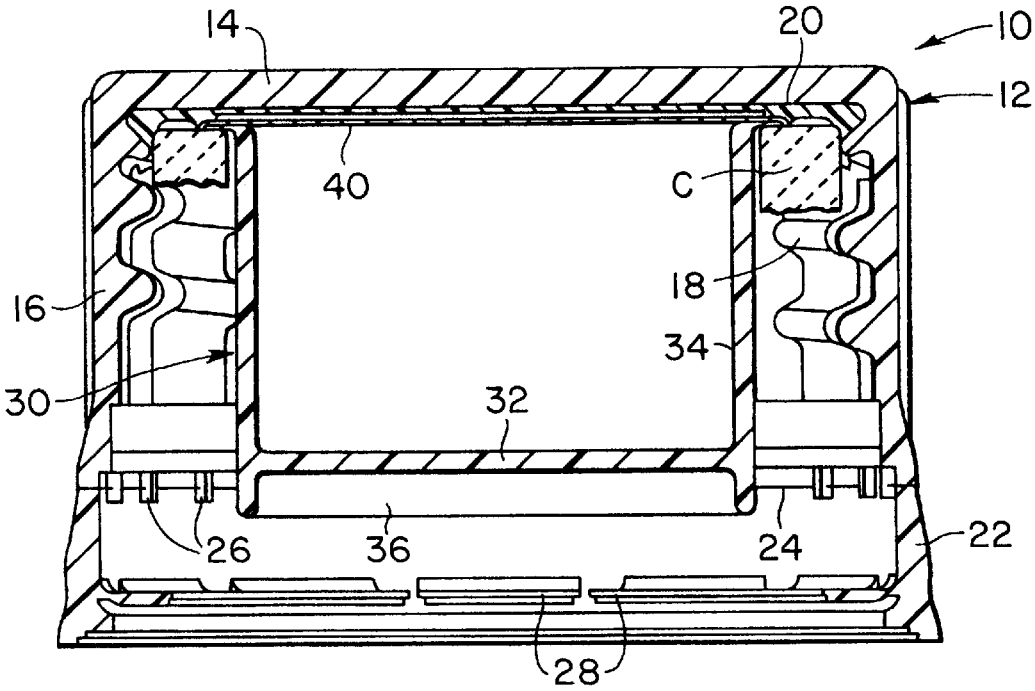
FIG. 1 is a side elevational cross-sectional view of a promotional closure having an easy-open promotion-receiving member embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a promotional closure 10 including an easy-open promotion-receiving member embodying the principles of the present invention. Promotional closure 10 is particularly configured for use with an associated container, a portion of which is illustrated and is designated C, such as by threaded application to a neck portion of the container. Closures of the type illustrated in FIG. 1 can be formed in accordance with the teachings of U.S. Pat. No. 4,497,795, hereby incorporated by reference.

Closure 10 includes a molded plastic outer closure cap 12 having a circular top wall portion 14 and a depending annular skirt portion 16. The annular skirt portion 16 includes an internal helical thread formation 18 configured for cooperating threaded engagement with the associated container C. A sealing liner 20 positioned adjacent the top wall portion 14 of the closure facilitates sealing engagement of the closure with an associated container, and permits the closure to be configured for use with containers having carbonated contents.

The illustrated closure 10 is of the so-called tamper-indicating type, and includes a detachable pilfer band 22 depending from the annular skirt portion 16. The pilfer band 22 is distinguished from the upper closure cap 12 by a circumferentially extending scoreline 24, with a plurality of circumferentially extending frangible ribs 26 extending between the inside surfaces of the closure cap and the pilfer band. A plurality of circumferentially spaced container-engaging flexible projections 28 extend inwardly of the pilfer band, for cooperating engagement with the locking portion of the associated container. By such cooperating engagement, the frangible ribs 26 split and fracture during removal of the closure from the container, thereby separating the pilfer band from the skirt portion 16 of the closure cap for the desired tamper-evidence. The illustrated embodiment of the pilfer band is configured in accordance with U.S. Pat. No. 4,938,370, hereby incorporated by reference, but may alternately be configured in accordance with the teachings of U.S. Pat. No. 4,418,828, hereby incorporated by reference.

Figure 2:
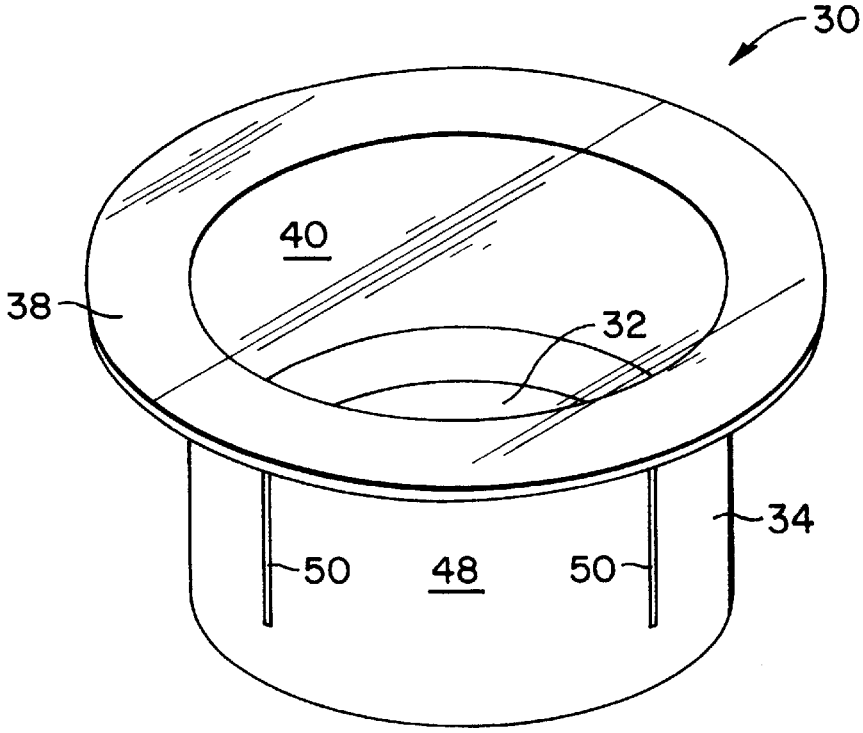
FIG. 2 is a top perspective view of the promotion-receiving member of the present invention.
Figure 3:
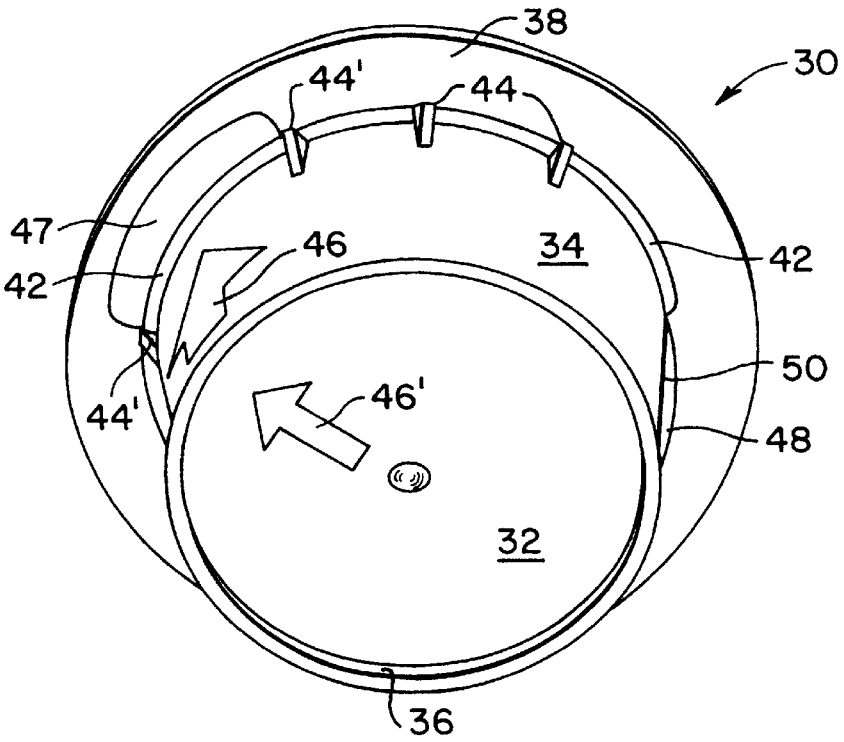
FIG. 3 is a bottom perspective view of the promotion-receiving member of the present invention.

The closure 10 is intended for use in connection with consumer promotions or games, and to this end, the closure includes a promotion-receiving member positioned generally within the closure cap 12. As illustrated in FIGS. 2 and 3, the promotion-receiving member is provided in the form of a promotion compartment 30 having a generally cup-shaped configuration including a circular bottom wall 32, and a generally cylindrical upstanding side wall 34 extending upwardly from the bottom wall 32. In the preferred form, the promotion compartment 30 includes a depending annular flange 36 which facilitates removal of the compartment from within the closure cap 12.

The compartment 30 is preferably of unitary construction, and preferably molded from low density polyethylene plastic material which, as will be further described, facilitates opening or splitting of the compartment so that a promotional element positioned within the compartment can be easily removed by consumers. Positioning of the compartment 30 within the closure cap 12 is facilitated by the provision of an annular flange 38 which extends generally outwardly from the upper edge of the side wall 34. The annular flange 38 can be interengaged with a portion of the sealing liner 20 of closure 10, such as by the provision of a deformable bead or flange on the liner which fits between the container C and the flange 38. As will be observed in FIG. 2, the flange 38 is held in generally captive relationship between the container C and the inside surface of the liner 20 within closure cap 12.

A suitable promotional element (not shown) can be positioned within the interior of the compartment 30. Such a promotional element can be provided in the form of a coupon redeemable for an award or the like, folded currency (i.e., cash), or some other suitable promotional article. Retention of the promotional element within the compartment is desirably enhanced by the optional provision of a cover member 40 fitted to the flange 38, which cover member 40 can be provided in the form of a suitable plastic film or the like heat-sealed or otherwise secured to the flange 38 of the compartment. The cover 40 further acts to desirably isolate the contents of the compartment from the contents of the associated container C, and to desirably enhance the structural integrity of the compartment 30 without impairing easy-opening of the compartment.

One size of closure commonly used for containers for carbonated beverages has a diameter of 28 millimeters, with a promotion compartment embodying the principles of the present invention sized for disposition within an associated container when a closure of this size is applied thereto. While a promotion compartment in accordance with this invention can be configured for use with closures of many different sizes, use in connection with a 28 millimeter closure necessarily requires that the promotion compartment be relatively small in size. As such, removal of a promotional element from within the compartment should be as easy as possible to permit removal by consumers without resort to use of a tool or other implement.

Accordingly, the promotion compartment 30 in accordance with the present invention is configured for easy-opening, that is, is configured to split or open in a fashion which permits the contents of the compartment to be easily removed without the use of an associated implement. Generally, the annular flange 38 of the compartment acts in the nature of a pull-ring or finger grip to facilitate splitting or opening of the side wall 34 of the compartment. Thus, even when the promotion compartment 30 is sized for use with 28 millimeter closures, consumers can very easily gain access to the contents of the compartment.

In order to provide the desired easy-open function, the annular flange 38 includes a portion which is detachable from the side wall 34 of the compartment 30, with this detachable portion being defined by a circumferentially extending preferentially weakened region 42. The weakened region 42 is preferably provided in the form of a relatively thin, fracturable membrane-like element which is formed during molding of the promotion compartment.

In the preferred form, a plurality of circumferentially spaced frangible gussets 44 extend between the side wall 34 and the flange 38 along the weakened region 42. In the preferred form, a pair of the gussets, designated 44', are spaced apart to define a gusset-free finger grip region of the detachable portion of the annular flange 38 (see FIG. 3). It is further preferred that indicia means, such as in the form of molded-in arrow 46, be positioned adjacent the gusset-free finger grip of the annular flange, generally between the gussets 44', thus providing convenient indication of that portion of the annular flange member which is to be initially detached from the side wall 34 of the compartment. An additional indicia means, such as in the form of molded-in arrow 46', can optionally be provided on the outside surface of bottom wall 32, as shown in FIG. 3. Further indicia means can be provided on the annular flange 38, such as by the provision of a molded-in finger grip 47, as well as by the optional provision of a pair of spaced apart grip-indicating marks 47' (shown in FIG. 4).

Splitting or opening of the compartment 30 is preferably provided by the provision of a frangible portion in the side wall 34 which can be opened by detaching annular flange 38 from the remainder of the side wall. In the illustrated embodiment, the frangible portion of the side wall is provided in the form of a hinged side wall section 48 which extends between a pair of circumferentially spaced, axially extending preferentially weakened regions 50 in the side wall 34. The weakened regions 50 are preferably relatively thin, molded portions of the side wall of the compartment 30. The side wall section 48 is hinged at a lower edge thereof so that after fracture of the frangible portions 50, the side wall section 48 can be moved hingedly outwardly by manipulation of annular flange 38, thus splitting and opening the compartment for convenient access to its contents. The weakened region 42 preferably extends to, and terminates at, opposite sides of side wall section 48 so that the annular flange 38 remains attached to the section 48 after opening of the compartment.

From the foregoing, the manner in which the promotion compartment 30 is opened by consumers will be readily appreciated. After the closure 10 is removed from the associated container C, the compartment 30 can be easily removed from within the closure cap 12 by manipulation of depending flange 36. Upon removal of the promotion compartment from the closure cap, examination of the compartment indicates that a finger grip portion of annular flange 38 is positioned adjacent indicating arrow 46 (which, as noted, is positioned between gussets 44', and in diametrically opposed relationship to side wall section 43).

Figure 4:
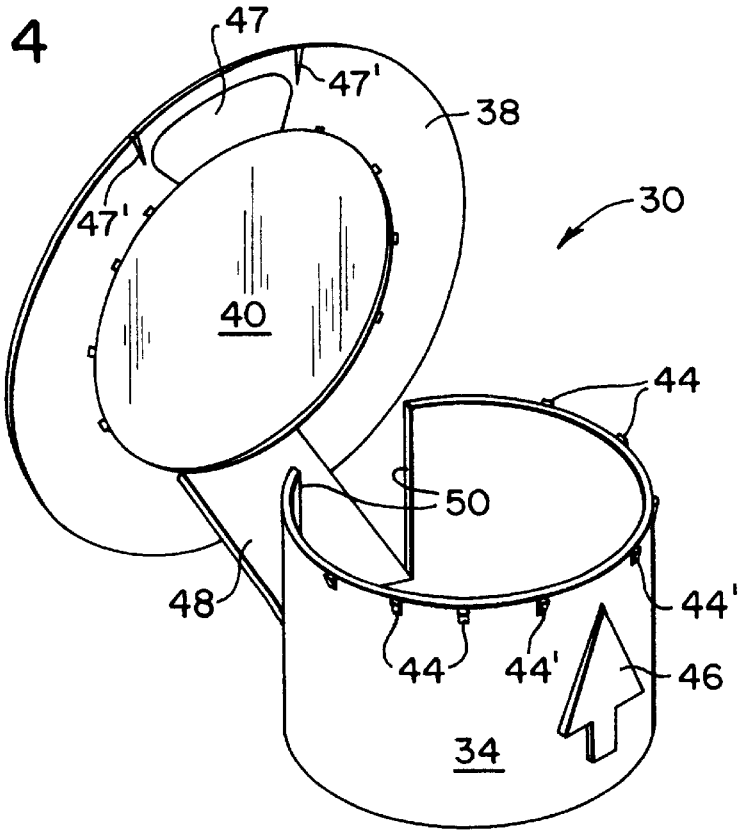
FIG. 4 is a perspective view illustrating opening of the promotion-receiving member of the present invention.

Opening of the compartment is illustrated in FIG. 4. As a consumer grips the side wall 34 of the compartment, opening pressure on the finger grip of the annular flange results in tear proprogation and fracture of weakened region 42, and fracture of frangible gussets 44. As the annular flange is detached from the side wall, the annular flange assumes the configuration of a pull-ring or pull-tab to facilitate gripping. The cover 40 may remain in place on the annular flange 38 during this opening action.

As a consumer continues to exert force on the annular flange 38, the flange detaches from side wall 34, except for hinged side wall section 48, to which the flange remains connected. This connection permits the annular flange to exert force upon the side wall section, which in turn results in fracture of frangible regions 50 in the side wall. The side wall section 48 thus opens in a hinged manner, whereby the contents of the compartment can be easily removed.

The preferred manufacture of the promotion compartment 30 from low density polyethylene plastic material facilitates the desired splitting and fracture of the compartment under the exertion of normal pressure during manipulation by consumers. The preferred provision of circumferentially extending weakened region 42, and axially extending frangible regions 50 as relatively thin, molded regions, maintains the desired sealed nature of the interior of the compartment, while still facilitating opening of the compartment by fracture of these regions. In a current embodiment of the present promotion compartment, the detachable portion of the annular flange extends through about 270° of the circumference of the compartment 30 with the hingedly detachable side wall section 48 thus extending through about 90° of the circumference of the side wall 34. As will be appreciated, the exact configuration of the detachable flange portion, and detachable side wall section, can be varied in accordance with the principles disclosed herein, but it is presently preferred that the detachable flange portion extend to more than about 180° of the compartment circumference, with the side wall section 48 extending through less than about 180° of the circumference of the compartment.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A promotional closure adapted for application to an associated container comprising:

a closure cap having a top wall portion and a depending annular skirt portion; and a promotion-receiving member comprising a promotion compartment positionable generally beneath said top wall portion of said closure cap and inwardly of said annular skirt portion for disposition generally within said container, said promotion compartment having a generally cup-shaped configuration, including a bottom wall, and an upstanding side wall extending upwardly therefrom, said side wall comprising a frangible portion which can be opened by splitting said side wall after said closure is removed from said container and said promotion compartment is removed from within said closure sap, opening of said frangible portion facilitating removal of a promotional element from within said promotion compartment;

said frangible portion of said side wall comprises a side wall section and a pair of spaced apart preferentially weakened regions between which said side wall section is positioned, said promotion compartment including a finger grip connected to said side wall section for gripping said side wall section to facilitate fracture of said weakened regions.

2. A promotional closure in accordance with claim 1, wherein said preferentially weakened regions extend generally axially of said compartment, fracture of said weakened regions permitting hinging movement of said side wall section about hinge means joining said side wall section to the remainder of said compartment.

3. A promotional closure in accordance with claim 2, wherein said promotion compartment includes an annular flange extending outwardly from said side wall, said annular flange being joined to said side wall section, and detachable from the remainder of said side wall to provide said said finger grip connected to said side wall section.

4. A promotional closure in accordance with claim 3, including a plurality of circumferentially spaced gussets extending between said side wall and said annular flange.

5. A promotional closure adapted for application to an associated container comprising:

a plastic promotion compartment positionable generally beneath said top wall portion of said closure cap and inwardly of said annular skirt portion for disposition generally within said container, said compartment having a generally cup-shaped configuration, including a bottom wall, and an upstanding side wall extending upwardly therefrom, said compartment further including an annular flange extending outwardly from said upstanding side wall, said compartment including means for detaching a detachable portion of said annular flange from said side wall by gripping and manipulating said detachable portion of said annular flange to facilitate removal of a promotion element from within said promotion compartment by splitting of said side wall after said closure is removed from said container, and said promotion compartment is removed from within said closure cap.

6. A promotional closure in accordance with claim 5, wherein said side wall of said compartment includes frangible means joined to said annular flange, said frangible means being openable by gripping and manipulating said annular flange to facilitate removal of said promotional element.

7. A promotional closure in accordance with claim 6, wherein said frangible means is hingedly joined by hinge means to the remainder of said compartment after said detachable portion of said annular flange is detached from said side wall and manipulated to open said frangible means.

8. A promotional closure in accordance with claim 6, including indicia means on said compartment for indicating said portion of said annular flange to be detached from said side wall.

9. A promotional closure in accordance with claim 6, including a plurality of circumferentially spaced frangible gussets extending between said portion of said flange and said side wall.

10. A promotional closure in accordance with claim 5, wherein said plastic promotion compartment comprise low density polyethylene.

11. A promotional closure adapted for application to an associated container comprising:

a closure cap having a top wall portion and a depending annular skirt portion; and a promotion-receiving member comprising a plastic promotion compartment positionable generally beneath said top wall portion of said closure cap and inwardly of said annular skirt portion for disposition generally within said container, said compartment having a generally cup-shaped configuration, including a bottom wall, and an upstanding side wall extending upwardly therefrom, said compartment further including an annular flange extending outwardly from said upstanding side wall, said compartment including means for detaching a detachable portion of said annular flange from said side wall to facilitate removal of a promotion element from within said promotion compartment after said closure is removed from said container, and said promotion compartment is removed from within said closure cap, a plurality of circumferentially spaced frangible gussets extending between said portion of said flange and said side wall, wherein a pair of said gussets are spaced apart to define a gusset-free finger grip of said detachable portion of said annular flange.

12. A promotional closure in accordance with claim 11, including indicia means on said compartment positioned adjacent said gusset-free finger grip.

* * * * *